US005168639A

United States Patent [19]

Hebels

[11] Patent Number: 5,168,639

[45] Date of Patent: Dec. 8, 1992

[54] METHOD OF AND APPARATUS FOR CONDENSING VAPOROUS SUBSTANCES

[75] Inventor: Albert Hebels, Kellinghusen, Fed. Rep. of Germany

[73] Assignee: Pagendarm GmbH, Hamburg, Fed. Rep. of Germany

[21] Appl. No.: 673,748

[22] Filed: Mar. 22, 1991

[30] Foreign Application Priority Data

Mar. 27, 1990 [DE] Fed. Rep. of Germany ..... 4009797

[51] Int. Cl.[5] ..... F26B 7/00

[52] U.S. Cl. ..... 34/13; 34/62; 34/74; 34/155; 34/23

[58] Field of Search ..... 34/151, 155, 156, 10, 34/62, 23, 13, 74

[56] References Cited

U.S. PATENT DOCUMENTS

| | | | |
|---|---|---|---|
| 4,462,169 | 7/1984 | Daane | 34/62 |
| 4,764,402 | 8/1988 | Pagendarm | 427/355 |
| 4,886,564 | 12/1989 | Pagendarm | 156/230 |
| 4,904,425 | 2/1990 | Hebels | 264/40.1 |
| 5,001,845 | 3/1991 | Norz et al. | 34/79 X |

*Primary Examiner*—Henry A. Bennet
*Attorney, Agent, or Firm*—Peter K. Kontler

[57] ABSTRACT

A running web the upper side of which is coated with one or more films containing a volatile substance is heated from below in a housing which contains a driven cooled condensing roller in the space above the path for the web. The vaporous substance which is expelled as a result of heating of the web is condensed on the peripheral surface of the cooled roller, and the film of condensate is stripped off the peripheral surface to enter an evacuating trough. The rate of condensation can be regulated by changing the rotational speed of the roller in dependency upon variations of pressure of vaporous substance above the running web and/or in dependency on the monitored rate of escape of vaporous substance into the atmosphere. Alternatively, or in addition to regulation of condensation in response to signals from pressure- and/or flow rate monitoring sensors, the rate of condensation can be adjusted by altering the cooling action upon the roller in dependency on fluctuations of pressure in the housing and/or in dependency on the rate of flow of vaporous substance into the atmosphere.

15 Claims, 1 Drawing Sheet

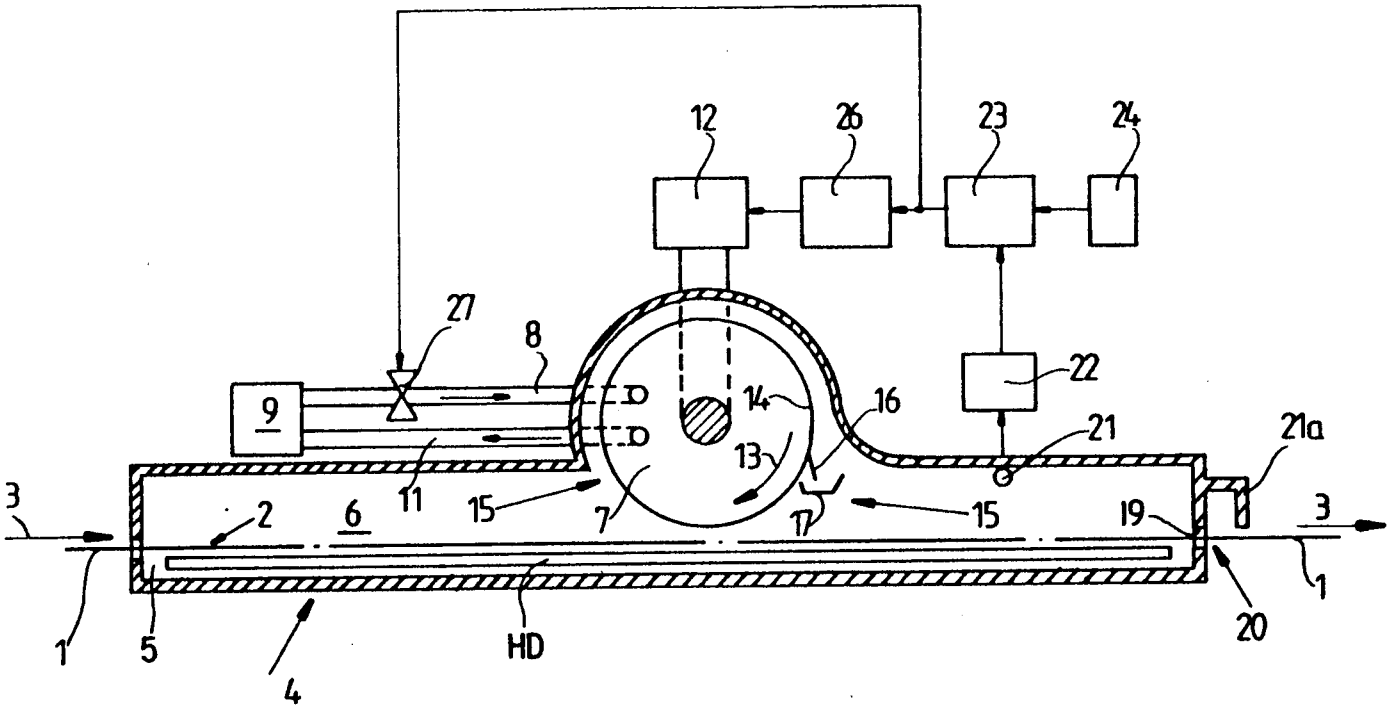
3
1
21a
20
19
24
22
21
23
15
26
16
17
12
14
13
7
8
15
HD
27
11
6
9
2
4
5
1
3

METHOD OF AND APPARATUS FOR CONDENSING VAPOROUS SUBSTANCES

BACKGROUND OF THE INVENTION

The invention relates to improvements in methods of and in apparatus for condensing vaporous substances. More particularly, the invention relates to improvements in methods of and in apparatus for condensing vaporous substances which are expelled as a result of drying and/or heating of a running web of plastic, textile or other material which carries one or more layers containing one or more volatile substances. Examples of webs which can be treated in accordance with the method of and in the apparatus of the present invention are substrates of paper, fabric, plastic or other materials which carry one or more films of a solvent-containing adhesive.

The application of films to running webs of textile or other material often involves the use of a volatile solvent which is contained in the material of the film or films and must be expelled when the application of the film or films is completed. The solvent cannot or should not be permitted to escape into the surrounding atmosphere. In fact, many countries enforce strict laws which prohibit the release of certain solvents into the atmosphere for ecological reasons. Furthermore, it is often desirable to recover vaporous solvents for renewed use.

Recovery of vaporous substances normally involves heating the running web to promote expulsion of volatile solvent, and thereupon condensing the resulting vaporous substance. The arrangement is or can be such that the normally combustible vaporous substance which is released by a running web into a vapor-collecting chamber is maintained outside of the explosion limits. If the vaporous substance is maintained below the lower explosion limit, the percentage of air is higher which complicates the removal of vaporized solvent. On the other hand, if the vaporized solvent is maintained above the lower explosion limit, the condensing step is relatively simple but expensive precautionary measures must be undertaken in order to prevent contact of vaporous substance with oxygen because this would create the danger of combustion or explosion.

OBJECTS OF THE INVENTION

An object of the invention is to provide a simple and inexpensive but reliable method of condensing vaporous substances which are expelled from running webs of textile, plastic or other material.

Another object of the invention is to provide a method which renders it possible to regulate condensation of one or more vaporous substances in a number of different ways.

A further object of the invention is to provide a method which renders it possible to prevent dripping of condensed-vaporous substance or substances onto the web or webs.

An additional object of the invention is to provide a novel and improved method of condensing vaporized solvent which is expelled from one or more adhesive films or other solvent-containing films adhering to a running web of paper, fabric or other flexible material.

Still another object of the invention is to provide a novel and improved apparatus for the practice of the above outlined method.

A further object of the invention is to provide the apparatus with novel and improved means for preventing the condensate from dripping onto the running web which is being heated and/or otherwise treated in order to promote the expulsion of volatile solvents or other vaporous substances.

An additional object of the invention is to provide the apparatus with novel and improved means for regulating the progress of condensation of vaporous substance or substances adjacent the path for one or more running webs which are in the process of being heated or dried to promote expulsion of solvents or other volatile substances.

A further object of the invention is to provide the apparatus with novel and improved means for preventing admixture of oxygen to combustible or explosive vaporous substances.

Another object of the invention is to provide an apparatus which constitutes an improvement over and a further development of apparatus described and shown in the commonly owned copending patent application Ser. No. 07/558,579 filed Jul. 27, 1990.

SUMMARY OF THE INVENTION

One feature of the present invention resides in the provision of a method of controlledly condensing a vaporous substance (such as a volatile solvent) which issues from a heated web of fabric, paper, plastic or the like while the web advances along a predetermined path. The method comprises the steps of positioning at least one rotary surface adjacent the oath, and cooling the at least one rotary surface to promote condensation of the vaporous substance on the at least one surface.

In many instances, the vaporous substance will issue from at least one layer or film which is applied to the upper side of the web in the path. The positioning step then preferably comprises placing the at least one rotary surface adjacent the upper side of the path for the web.

The method can further comprise the step of influencing the rate of condensation of vaporous substance on the at least one rotary surface, and such influencing step can comprise confining the at least one surface and the web in a chamber which is at least substantially sealed from the surrounding atmosphere and wherein the pressure tends to rise as a result of evaporation of vaporous substance from the heated web, and regulating the pressure in the chamber. The regulating step can include maintaining the pressure in the chamber at a substantially constant value, preferably at a value slightly above atmospheric pressure so as to prevent, or at least greatly reduce, the likelihood of penetration of atmospheric air into the chamber.

The confining step can include establishing a housing which surrounds the path for the running web and the at least one rotary surface. The chamber and the at least one surface are located in the housing above the oath for the web.

The influencing step can comprise varying the rotational speed of the at least one surface and/or regulating the cooling step.

The method further comprises the steps of stripping condensate off the at least one surface and collecting the stripped condensate.

Another feature of the invention resides in the provision of an apparatus for controlled condensing of a vaporous substance which issues from a heated web while the web advances along a predetermined (e.g., substantially horizontal) path. The apparatus comprises a housing defining a chamber including a space which is disposed above the path to receive the vaporous substance which issues from the web, at least one rotary element (hereinafter called roller for short) which is disposed in the housing and has a peripheral surface exposed to the vaporous substance in the space, and means for cooling the peripheral surface of the at least one roller to promote condensation of vaporous substance on the peripheral surface. The apparatus further comprises means for heating the web, e.g., in the housing beneath the path for the web.

It is presently preferred to mount the at least one roller in the aforementioned space.

The apparatus can further comprise means for influencing the rate of condensation of vaporous substance on the surface of the at least one roller; such influencing means can include means for monitoring the pressure of vaporous substance in the space, and means for regulating the rotational speed of the at least one roller as a function of monitored pressure of vaporous substance.

The influencing means can further comprise (or can comprise in lieu of the aforedescribed influencing means) means for establishing at least one passage for the flow of vaporous substance from the space into the surrounding atmosphere, means for monitoring the rate of flow of vaporous substance from the space into the atmosphere, and means for regulating the rotational speed of the at least one roller as a function of the monitored rate of flow of vaporous substance into the atmosphere.

Still further, or in lieu of one or both aforedescribed influencing means, the influencing means can comprise means for monitoring the pressure of vaporous substance in the space, and means for adjusting the cooling means as a function of monitored pressure of the vaporous substance in the space. In addition, or in lieu of the aforedescribed influencing means, the influencing means can include means for establishing at least one passage for the flow of vaporous substance from the space into the surrounding atmosphere, means for monitoring the rate of flow of vaporous substance into the atmosphere, and means for adjusting the cooling means as a function of the monitored rate of flow of vaporous substance into the atmosphere.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

The single Figure of the drawing is a schematic longitudinal vertical sectional view of an apparatus which embodies one form of the invention and wherein the rate of condensation of a vaporous substance in the space above the upper side of a running web can be regulated in a number of different ways.

DESCRIPTION OF PREFERRED EMBODIMENTS

The single Figure of the drawing shows an elongated web 1 of paper, plastic, textile or other material which is advanced in the direction of arrows 3 along an elongated substantially horizontal path a portion of which extends through a housing 4. The web 1 is located in a plane which extends at right angles to the plane of the drawing, and its upper side 2 is provided with one or more layers, films or similar coatings of adhesive which contains a solvent or another vaporizable substance. The internal chamber of the housing 4 includes an upper compartment or space 6 above the respective portion of the path for the web 1, and a lower compartment or space 5 for a suitable heating device HD which serves to heat the web and to thus promote vaporization of solvent or another vaporizable substance into the space 6. The heating device HD in the space 5 beneath the path for the web 1 in the housing 4 can include a heat exchanger which circulates a heated gas, a source of radiation heat, a source of convection heat or any other suitable heating device. Reference may be had, for example, to commonly owned, U.S. Pat. No. 4,886,564 to Pagendarm et al and to commonly owned U.S. Pat. No. 4,904,425 to Hebels et al. These patents disclose certain types of suitable heating means for a running web of paper, plastic or the like. The disclosures of the patents are incorporated herein by reference.

In accordance with a feature of the invention, the apparatus comprises at least one rotary roller 7 (the drawing shows a single horizontal roller) which is installed in the space 6 above the path for the web 1 in the housing 4 and has a cylindrical peripheral surface 14 which is cooled while the roller 7 is driven by a variable-speed electric motor 12. The cooling unit includes a source 9 of liquid, vaporous, gaseous or other suitable coolant, a supply conduit 8 which delivers fresh coolant into the interior of the roller 7, and a return conduit 11 which delivers spent coolant to the source 9 for cooling or to another destination. The axis of the roller 7 is normal to the plane of the drawing, i.e., such axis extends at right angles to the direction of advancement of the web 1 in the housing 4. If the apparatus employs two or more rollers 7, such rollers are preferably rotatable about parallel axes and are located one behind the other, as seen in the direction of arrows 3.

The peripheral surface 14 of the illustrated roller 7 is exposed to the vaporous substance which gathers in the upper space 6 of the chamber in the housing 4, and such substance condenses on the peripheral surface 14 as a result of continuous cooling of the roller 7. The direction in which the motor 12 drives the roller 7 is indicated by arrow 13. The arrows 15 indicate the directions in which the vaporous substance which issues from the layer or layers at the upper side 2 of the web 1 (as a result of the provision of the heating device HD in the lower space 5 of the chamber in the housing 4) flows toward and against the peripheral surface 14. The film of liquid condensate which deposits on the peripheral surface 14 is stripped off by one or more doctor blades 16 or other suitable tools which direct the condensate into a collecting trough 17 for controlled evacuation from the housing 4. The trough 17 is or can be heated to prevent condensation of vaporous substance at is underside; such condensate could drip off the trough 17 and onto the running web 1.

The rate of condensation of vaporous substance in the space 6 to form a liquid film on the surface 14 of the rotating roller 7 can be influenced in a number of ways. One mode of influencing the rate of condensation is by utilizing signals which are generated by a pressure monitoring sensor 21 in the space 6 above the web 1 in the housing 4. The pressure in the space 6 is attributable primarily to the presence of vaporous substance which is expelled by heat from the layer or layers at the upper side 2 of the web 1. The sensor 21 transmits signals to an amplifier 22 which, in turn, transmits amplified signals (denoting the pressure of vaporous substance in the space 6) to a signal comparing stage 23. The stage 23 compares the amplified signal from the amplifier 22 with a preselected reference signal which is supplied by an adjustable potentiometer 234 or any other suitable source of reference signals. When the actual-pressure signal from the amplifier 22 deviates from the reference signal, the signal comparing stage 23 transmits a signal from the amplifier 22 deviates from the reference signal, the signal comparing stage 23 transmits a signal to an operational amplifier 26 which regulates the speed of the motor 12 and hence the rotational speed of the roller 7 and of its peripheral surface 14. The arrangement is such that the RPM of the roller 7 is increased in response to rising pressure in the space 6 and that the RPM of the roller 7 is reduced when the pressure of vaporous substance in the space 6 drops.

The rate of condensation can be influenced by a second sensor 21*a* which monitors the rate of flow of vaporous substance from the space 6 by way of a passage 19 (e.g., in the form of a narrow) horizontal slit) which is defined by a portion 20 of the housing 4, preferably at the locus where the web 1 leaves the housing. The sensor 21*a* can monitor the rate of flow of vaporous substance into the surrounding atmosphere by employing a mobile element (e.g., a float or a flag, not shown) which is entrained by the vaporous substance escaping via passage 19 to thereby change its position relative to a stationary marker (not shown). The intensity and/or another characteristic of the signal which is generated by the sensor 21*a* is indicative of the rate of flow of vaporous substance from the space 6 through the passage 19, and such signal is used to control the RPM of the roller 7 by way of the operational amplifier 26 and motor 12. The means for actually generating signals which denote the monitored rate of flow of a vaporous substance from the space 6 can include an optical or an inductive transducer, not specifically shown. Signals from the sensor 21*a* are preferably used to regulate the RPM of the roller 7 in such a way that the pressure in the space 6 remains at least substantially constant and is slightly above atmospheric pressure; this prevents penetration of oxygen-containing air into the housing 4 and admixture of oxygen of the normally combustible and/or explosive vaporous substance in the space 6. It is preferred to maintain the pressure in the space 6 only slightly above the atmospheric pressure because this prevents the escape of large quantities of vaporous substance from the space 6 and into the area around the housing 4.

If the pressure inn the space 6 and/or the rate of escape of vaporous substance through the passage 19 exceeds a value which can be controlled by mere varying of rotational speed of the roller 7, the signal from the sensor 21 and/or from the sensor 21*a* is used to adjust a regulating valve 27 which is installed in the supply conduit 8 and serves to regulate the cooling action upon the surface 14. The valve 27 (and/or another regulating element) can vary the rate of flow of coolant from the source 9 into the roller 7 and/or the temperature of coolant in the source 9 and/or in the conduit 8 (i.e., in the roller 7). In either event, the pressure in the space 6 is or can be regulated in such a way that it is slightly above atmospheric pressure in order to prevent penetration of oxygen into the housing 4 while, at the same time, preventing escape of excessive quantities of vaporous substance from the housing 4 into the surrounding atmosphere.

Each of the aforedescribed four influencing means can be used alone or in combination with one, two or all three other influencing means.

It is often desirable to flush the chamber 5, 6 of the housing with an inert gas (e.g., nitrogen) before the improved apparatus is put to actual use. Flushing of the space above the path for a running web within a housing wherein the web is heated to be relieved of vaporizable substances is disclosed, for example, in the aforementioned commonly owned U.S. Pat. No. 4,886,564 to Pagendarm et al. Commonly owned U.S. Pat. No. 4,764,402 to Pagendarm et al. describes and shows an apparatus which can be used to apply one or more coats or films of an adhesive or other suitable material to one side of a running substrate of textile, paper, plastic or other material.

An important advantage of the improved method and apparatus is that the likelihood of dripping of condensate onto the running web 1 is greatly reduced or eliminated. In addition, the vaporous substance or substances can be condensed and the condensate can be removed from the condensing station in a simple and inexpensive way. Still further, the rate of condensation can be regulated within the desired range by resorting to relatively simple, inexpensive and reliable monitoring and regulating means.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of controlledly condensing a vaporous substance which issues from at least one layer at the upper side of a heated web while the web advances along a predetermined path, comprising the steps of positioning at least one rotary surface adjacent said path, including placing the at least one rotary surface adjacent the upper side of the web in said path; heating the web from below; and cooling the at least one rotary surface to promote condensation of the vaporous substance thereon.

2. The method of claim 1, wherein said vaporous substance is a volatile solvent.

3. The method of claim 1, further comprising the step of influencing the rate of condensation of vaporous substance on said at least one surface, including confining the at least one surface and the web in said path in a chamber which is at least substantially sealed from the surrounding atmosphere and wherein the pressure tends to rise as a result of evaporation of vaporous substance, and regulating the pressure in the chamber.

4. The method of claim 3, wherein said regulating step includes maintaining the pressure in the chamber at a substantially constant value.

5. The method of claim 3, wherein said regulating step comprises maintaining the pressure in said chamber slightly above atmospheric pressure so as to prevent penetration of atmospheric air into the chamber.

6. The method of claim 3, wherein said confining step includes establishing a housing which surrounds said path and said at least one surface.

7. The method of claim 1, further comprising the step of influencing the rate of condensation of vaporous substance on said at least one surface, including varying the rotational speed of the at least one surface.

8. The method of claim 1, further comprising the step of influencing the rate of condensation of vaporous substance on the at least one surface, including regulating the cooling step.

9. The method of claim 1, further comprising the steps of stripping condensate off said at least one surface and collecting the thus stripped condensate.

10. Apparatus for controlled condensing of a vaporous substance which issues from a heated web while the web advances along a predetermined path, comprising a housing defining a space disposed above said path to receive vaporous substance which issues from the web; at least one roller disposed in said housing above said path and having a peripheral surface exposed to the vaporous substance in said space; means for heating the web in said housing beneath said path; and means for cooling said at least one roller to promote condensation of vaporous substance on said peripheral surface.

11. The apparatus of claim 1, wherein said at least one roller is located in said space.

12. The apparatus of claim 10, wherein said cooling means is adjustable and further comprising means for monitoring the pressure of vaporous substance in said space and means for adjusting said cooling means as a function of monitored pressure of the vaporous substance in said space.

13. Apparatus for controlled condensing of a vaporous substance which issues from a heated web while the web advances along a predetermined path, comprising a housing defining a space disposed above said path to receive vaporous substance which issued from the web; at least one roller disposed in said hosing and having a peripheral surface exposed to vaporous substance in said space; means for cooling said at least one roller to promote condensation of vaporous substance on said peripheral surface; and means for influencing the rate of condensation of vaporous substance on said surface, including means for monitoring the pressure of vaporous substance in said space and means for regulating the rotational speed of said at least one roller as a function of monitoring pressure.

14. Apparatus for controlled condensing of a vaporous substance which issues from a heated web while the web advances along a predetermined path, comprising a housing defining a space disposed above said path to receive vaporous substance which issues from the web; at least one roller disposed in said housing and having a peripheral surface exposed to vaporous substance in said space; means for cooling said at least one roller to promote condensation of vaporous substance on said peripheral surface; means for establishing at least one passage for the flow of vaporous substance from said space into the surrounding atmosphere; means for monitoring the rate of flow of vaporous substance from said space; and means for regulating the rotational speed of said at least one roller as a function of the monitored rate.

15. Apparatus for controlled condensing of a vaporous substance which issues from a heated web while the web advances along a predetermined path, comprising a housing defining a space disposed above said path to receive vaporous substance which issues from the web; at least one roller disposed in said housing and having a peripheral surface exposed to vaporous substance in said space; adjustable means for cooling said at least one roller to promote condensation of vaporous substance on said peripheral surface; means for establishing at least one passage for the flow of vaporous substance from said space into the surrounding atmosphere; means for monitoring the rate of flow of vaporous substance from said space; and means for adjusting said cooling means as a function of the monitored rate of flow of vaporous substance from said space.

* * * * *